US010207392B2

(12) United States Patent
Carter

(10) Patent No.: US 10,207,392 B2
(45) Date of Patent: Feb. 19, 2019

(54) ABRASIVE ARTICLE AND RELATED METHODS

(71) Applicant: 3M INNOVATIVE PROPERTIES COMPANY, St. Paul, MN (US)

(72) Inventor: Christopher J. Carter, Hinkley (GB)

(73) Assignee: 3M Innovative Properties Company, St. Paul, MN (US)

( * ) Notice: Subject to any disclaimer, the term of this patent is extended or adjusted under 35 U.S.C. 154(b) by 13 days.

(21) Appl. No.: 15/517,201

(22) PCT Filed: Sep. 30, 2015

(86) PCT No.: PCT/US2015/053101

§ 371 (c)(1),
(2) Date: Apr. 6, 2017

(87) PCT Pub. No.: WO2016/057279

PCT Pub. Date: Apr. 14, 2016

(65) Prior Publication Data

US 2017/0297171 A1 Oct. 19, 2017

Related U.S. Application Data

(60) Provisional application No. 62/060,651, filed on Oct. 7, 2014.

(51) Int. Cl.
*B24D 11/02* (2006.01)
*B24D 3/00* (2006.01)
(Continued)

(52) U.S. Cl.
CPC ..... *B24D 11/02* (2013.01); *B24B 37/042* (2013.01); *B24D 3/002* (2013.01); *B24D 11/001* (2013.01); *B24D 11/005* (2013.01); *B24D 11/008* (2013.01)

(58) Field of Classification Search
CPC ..... B24D 11/02; B24D 11/005; B24B 37/042
See application file for complete search history.

(56) References Cited

U.S. PATENT DOCUMENTS 4,714,644 A * 12/1987 Rich ..... B24D 15/04 428/136
5,140,785 A * 8/1992 Eleouet ..... A47L 13/16 15/118

(Continued)

FOREIGN PATENT DOCUMENTS

CN 1141015 1/1997
CN 102574276 11/2015

(Continued)

OTHER PUBLICATIONS

3M Product Data Sheet, 3M™ 443SA Trizact Fine Finishing Discs (May 17, 2006) www.3M-automotive.de.

*Primary Examiner* — George Nguyen

(57) ABSTRACT

Provided are abrasive articles, and related methods, that include a flexible abrasive layer having opposed first and second major surfaces, a foam backing bonded to the second major surface, the foam backing being resiliently compressible, and a plurality of slits disposed on the first major surface and penetrating through the flexible abrasive layer and at least partially through the foam backing. In further disclosed embodiments, the abrasive article includes, a flexible abrasive layer having opposed first and second major surfaces, a structured member extending across the second major surface of the flexible abrasive layer, where the structured member and the flexible abrasive layer have respective three-dimensional patterns of discrete, isolated wells that correspond to each other, and a foam backing extending across a major surface of the structured member opposite the flexible abrasive layer, the foam backing being resiliently compressible.

10 Claims, 6 Drawing Sheets

(51) Int. Cl.
*B24D 11/00* (2006.01)
*B24B 37/04* (2012.01)

(56) References Cited

U.S. PATENT DOCUMENTS

| | | | | |
|---|---|---|---|---|
| 5,849,051 | A | 12/1998 | Beardsley | |
| 6,848,986 | B2 | 2/2005 | Kendall | |
| 7,235,114 | B1 | 6/2007 | Minick | |
| 9,193,039 | B2 * | 11/2015 | Zhai | B24D 3/002 |
| 9,839,991 | B2 * | 12/2017 | Whittaker | B24D 11/02 |
| 2007/0037500 | A1 | 2/2007 | Minick | |
| 2007/0066186 | A1 | 3/2007 | Annen | |
| 2007/0243798 | A1 | 10/2007 | Annen | |
| 2007/0243802 | A1 | 10/2007 | Peterson | |
| 2007/0254560 | A1 | 11/2007 | Woo | |
| 2010/0112920 | A1 * | 5/2010 | Usui | B24D 11/00 451/539 |
| 2010/0159805 | A1 | 6/2010 | Goldsmith | |
| 2010/0167630 | A1 | 7/2010 | Chung-fat | |
| 2012/0000135 | A1 | 1/2012 | Eilers | |
| 2012/0322352 | A1 * | 12/2012 | Petersen | B24D 3/002 451/539 |

FOREIGN PATENT DOCUMENTS

| | | |
|---|---|---|
| DE | 198 43 266 | 3/2000 |
| GB | 5 059 | 2/1911 |
| WO | WO 2010/004601 | 1/2010 |
| WO | WO 2010/077826 | 7/2010 |
| WO | WO 2011/087653 | 7/2011 |
| WO | WO 2011/148561 | 12/2011 |
| WO | WO 2012/046261 | 4/2012 |

* cited by examiner

ABRASIVE ARTICLE AND RELATED METHODS

CROSS REFERENCE TO RELATED APPLICATIONS

This application is a national stage filing under 35 U.S.C. 371 of PCT/US2015/053101, filed Sep. 30, 2015, which claims the benefit of US Provisional Patent Application No. 62/060,651, filed Oct. 7, 2014, the disclosures of which are incorporated by reference in their entirety herein.

FIELD OF THE INVENTION

Provided are flexible abrasive articles. More particularly, flexible abrasive articles are provided for surface finishing applications, such as for automotive and other vehicular exteriors.

BACKGROUND

Flexible abrasive articles are useful for removing a small amount of material from the surface of a workpiece (or substrate). This is commonly done to make the surface smoother, but such abrasives can also be intended to remove a layer of old material from a surface or even impart greater roughness to a surface in preparation for a repair.

Such abrasive articles are constructed by adhering abrasive particles to a flexible backing, such as paper, to form a coated abrasive. Sandpaper is a prime example. These sheet-like abrasives can be grasped by the hand or fastened to a sanding block and frictionally translated across the surface to be finished. Alternatively, the abrasive can be fastened to a reusable backup pad mounted to a disk sander, random orbital sander, or other power tool for rapid surface finishing. In these cases, the abrasive article typically incorporates some sort of attachment interface layer such as a hooked film, looped fabric, or adhesive for coupling to the backup pad.

In many applications, the flexible abrasive article is used with water or some other liquid, optionally containing a surfactant, which acts to lubricate and remove swarf and debris from the abrading surfaces. The liquid applied at the interface can reduce heat build-up and, in some cases, even be used to impart a surface treatment to the finished substrate.

Two problems are known to arise when performing a wet sanding operation. The first is known as "stiction," a phenomenon where the damp abrasive tends to bind and "stick" to the workpiece as a result of surface tension. Stiction can result in loss of user control over the abrading operation and consequent damage to the workpiece. The second is hydroplaning, which occurs when the abrasive and workpiece become separated by a thin layer of the liquid. This can cause the abrasive to skid across the surface without directly contacting the workpiece, degrading cut performance.

SUMMARY

The dual problems of stiction and hydroplaning are prevalent when performing wet sanding on painted surfaces. One way in which some have addressed these technical problems is by cutting or drilling holes or channels into the abrasive article to allow water to flow to and from the abrading interface. This can be an effective solution, but reduces the abrasive surface area and introduces a problem of pip removal, which is a nuisance. An alternative solution is to perforate the abrasive surface with pins, which avoids removal of the abrasive, but this can cause issues with re-sealing of the perforations in practice.

The problem of stiction can be similarly overcome by disposing holes and channels on the abrasive can allow sufficient water to be conveyed to the abrading surface. Yet, this solution often produced inconsistent water management and cut performance that was less than optimal. Both of these issues are addressed by the flexible abrasive articles provided herein.

In one aspect, an abrasive article is provided comprising: a flexible abrasive layer having opposed first and second major surfaces; a permeable backing bonded to the second major surface, the permeable backing being resiliently compressible; and a plurality of slits disposed on the first major surface and penetrating through the flexible abrasive layer and at least partially through the permeable backing.

In another aspect, an abrasive article is provided comprising: a flexible abrasive layer having opposed first and second major surfaces; a structured member extending across the second major surface of the flexible abrasive layer, wherein the structured member and the flexible abrasive layer have respective three-dimensional patterns of discrete, isolated wells that correspond to each other; and a permeable backing extending across a major surface of the structured member opposite the flexible abrasive layer, the permeable backing being resiliently compressible.

In still another aspect, a method of abrading a substrate using an aforementioned abrasive article is provided, the method comprising: applying a fluid to either the abrasive article or the substrate; and placing the abrasive article in frictional contact with the substrate, whereby the pattern of isolated wells retains fluid on the flexible abrasive layer and the slits dynamically distribute fluid within the foam layer.

In yet another aspect, a method of making an abrasive article is provided, comprising: disposing a structured member onto a permeable backing, wherein the permeable backing is resiliently compressible and the structured member has a three-dimensional pattern of discrete, isolated wells; and disposing a flexible abrasive layer on the structured member opposite the permeable backing to replicate at least a portion of the three-dimensional pattern onto the first major surface of the flexible abrasive layer.

The provided abrasive articles and methods answer the problems of stiction and hydroplaning by equalizing the hydrostatic pressure at the working surface of the abrasive through the slits while retaining a controlled degree of surface lubrication along the surface of the abrasive within the three-dimensional pattern.

BRIEF DESCRIPTION OF THE DRAWINGS

Exemplary embodiments will be further described with reference to the accompanying drawings as follows.

DEFINITIONS

As used herein:

"diameter" means the longest dimension of a given shape or object;

"inelastic" means not easily being resuming its original shape after being stretched or expanded by at least 10 percent;

"resilient" means capable of returning to an original shape or position, as after being stretched or compressed; and "three-dimensional" means having raised portions and recessed portions.

DETAILED DESCRIPTION

As used herein, the terms "preferred" and "preferably" refer to embodiments described herein that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein and in the appended claims, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

It is noted that the term "comprises" and variations thereof do not have a limiting meaning where these terms appear in the accompanying description. Moreover, "a," "an," "the," "at least one," and "one or more" are used interchangeably herein.

Relative terms such as left, right, forward, rearward, top, bottom, side, upper, lower, horizontal, vertical, and the like may be used herein and, if so, are from the perspective observed in the particular figure. These terms are used only to simplify the description, however, and not to limit the scope of the invention in any way.

Reference throughout this specification to "one embodiment," "certain embodiments," "one or more embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in one embodiment" or "in an embodiment" in various places throughout this specification are not necessarily referring to the same embodiment of the invention. Drawings are not necessarily to scale.

Abrasive Articles

Figure 1:
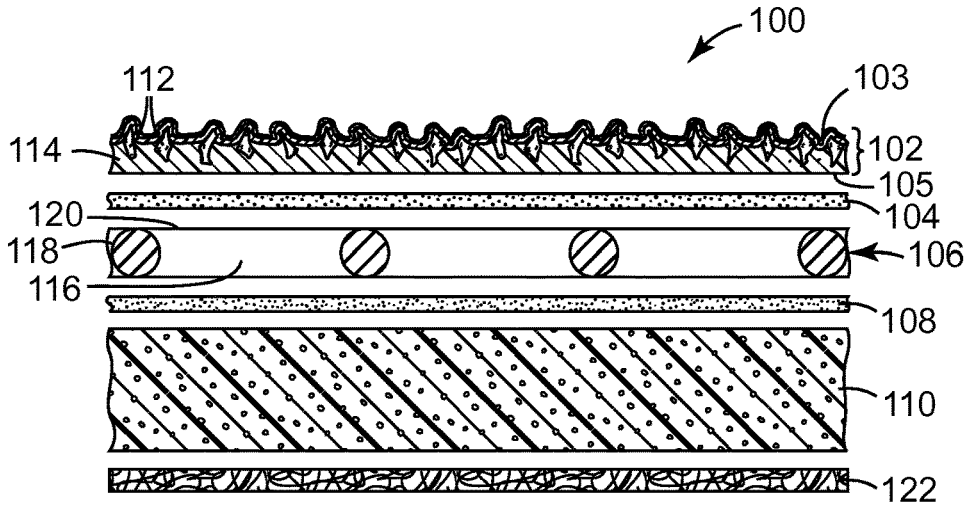
FIG. 1 is an exploded side cross-sectional view of an abrasive article according to one embodiment.

An abrasive article according to one exemplary embodiment, designated by the numeral 100, is shown in exploded view in FIG. 1. It is to be understood that the layered components depicted in this figure are illustrative only and may or may not assume the same shape or configuration when laminated or otherwise coupled together.

As shown, abrasive article 100 has a multi-layered construction. The multi-layered construction includes a flexible abrasive layer 102, a first adhesive layer 104, a structured member 106, a second adhesive layer 108, a permeable backing 110, and an attachment interface layer 122. Each component shall be described in order below.

The flexible abrasive layer 102, which has opposed first and second major surfaces 103, 105 as shown, is commonly either a coated abrasive or an abrasive composite. In either case, the abrasive is generally bonded to a suitable backing that enables the first major surface 103 of the flexible abrasive layer 102 to conform easily to a surface against which it is applied.

In one preferred embodiment, the flexible abrasive layer 102 is a coated abrasive film that includes a plurality of abrasive particles 112 secured to a carrier film 114. In some embodiments, the abrasive particles 112 are adhesively coupled to the carrier film 114 by implementing a sequence of coating operations involving curable make and size resins, as described for example in U.S. Patent Publication No. 2012/0000135 (Eilers et al.). When secured in this manner, the abrasive particles 112 are partially or fully embedded in make and size resins, but disposed sufficiently close to the surface of the abrasive article 100 that the abrasive particles 112 can frictionally contact against the substrate, or workpiece, in use.

In some cases, the carrier film 114 of the flexible abrasive layer 102 may be omitted where the binder has sufficient strength after hardening.

In an alternative embodiment, the flexible abrasive layer 102 may be an abrasive composite in which abrasive particles are uniformly mixed with a binder to form a slurry, which is then cast and hardened onto a backing surface.

Optionally, the abrasive slurry can be molded onto a carrier film to form a structured abrasive. Structured abrasive articles are generally prepared by obtaining a slurry of abrasive particles and hardenable precursor in a suitable binder resin (or binder precursor), casting the slurry onto a carrier film while confined within a mold, and then hardening the binder. The resulting abrasive article thus molded can have a plurality of tiny, precisely shaped abrasive composite structures affixed to the carrier film. The hardening of the binder can be achieved by exposure to an energy source. Such energy sources can include, for example, thermal energy and radiant energy derived from an electron beam, ultraviolet light, or visible light.

The abrasive particles 112 are not subject to any particular limitation and may be composed of any of a wide variety of hard minerals known in the art. Examples of suitable abrasive particles include, for example, fused aluminum oxide, heat treated aluminum oxide, white fused aluminum oxide, black silicon carbide, green silicon carbide, titanium diboride, boron carbide, silicon nitride, tungsten carbide, titanium carbide, diamond, cubic boron nitride, hexagonal boron nitride, garnet, fused alumina zirconia, alumina-based sol gel derived abrasive particles, silica, iron oxide, chromia, ceria, zirconia, titania, tin oxide, gamma alumina, and combinations thereof. The alumina abrasive particles may contain a metal oxide modifier. The diamond and cubic boron nitride abrasive particles may be monocrystalline or polycrystalline.

In nearly all cases there is a range or distribution of abrasive particle sizes. The number average particle size of the abrasive particles may range from between 0.001 and 300 micrometers, between 0.01 and 250 micrometers, or between 0.02 and 100 micrometers. Here, the particle size of the abrasive particle is measured by the longest dimension of the abrasive particle.

The carrier film 114 is also not particularly restricted so long as it has sufficient flexibility and conformability to allow substantial contact between the abrasive particles 112 and the substrate to be abraded. For example, the carrier film 114 can be made from a polymeric film, primed polymeric film, metal foil, cloth, paper, vulcanized fiber, nonwovens, treated versions thereof, and combinations thereof. Especially suitable carrier films include elastomeric polyurethane films.

In some embodiments, the carrier film 114 has a thickness that is generally uniform across its major surfaces. The average thickness of the backing may be at least 10 micrometers, at least 12 micrometers, at least 15 micrometers, at least 20 micrometers, or at least 25 micrometers. On the upper end, the average thickness of the backing may be at most 200 micrometers, at most 150 micrometers, at most 100 micrometers, at most 75 micrometers, or at most 50 micrometers. To enhance adhesion between the abrasive coating and the carrier film 114, the carrier film 114 may be chemically primed or otherwise surface treated, for example by corona treatment, UV treatment, electron beam treatment, flame treatment, or surface roughening.

Referring again to FIG. 1, the first adhesive layer 104 extends along the second major surface 105 of the flexible abrasive layer 102, coupling the flexible abrasive layer 102 and the underlying structured member 106 to each other. In a preferred embodiment, the first adhesive layer 104 is a pressure sensitive adhesive. For example, the first adhesive layer 104 could be a double-sided adhesive tape.

The structured member 106 has a three-dimensional pattern capable of producing a superimposed, conformal pattern on neighboring layers. In exemplary embodiments, the three-dimensional pattern is represented by a two-dimensional array of discrete, isolated wells.

Figure 2:
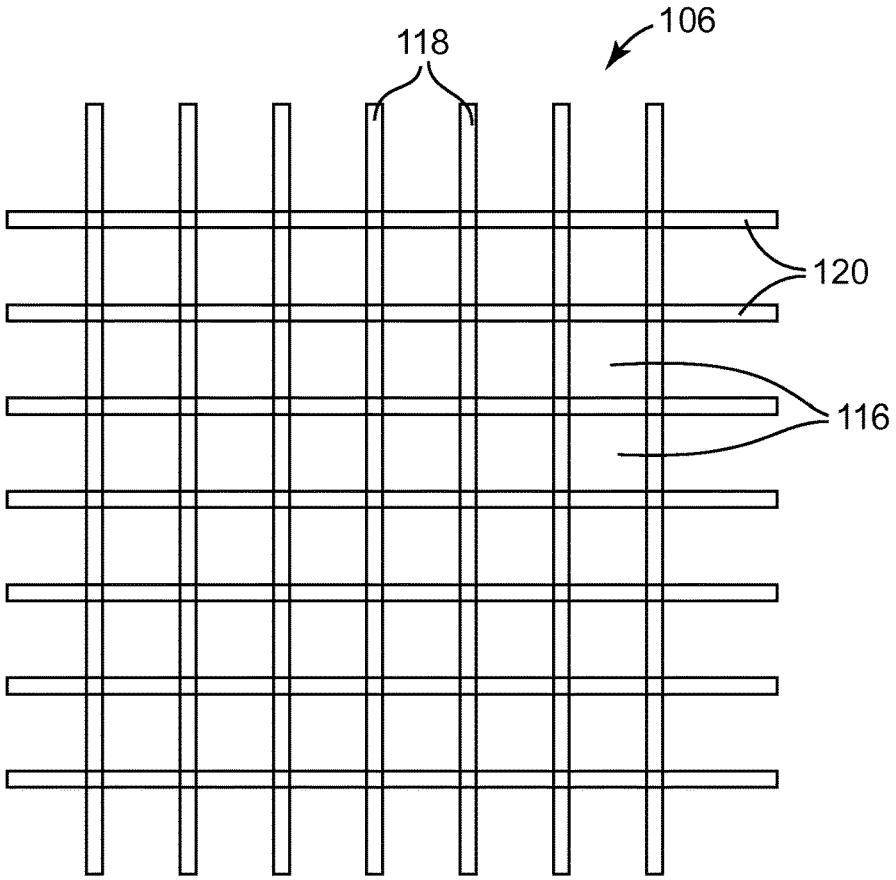
FIG. 2 is a plan view of a component of the abrasive article shown in FIG. 1.

Patterns generally useful for the structured member 106 include replicated two-dimensional arrays of holes or depressions. The holes present in such a pattern need not be round and could be either blind holes or through holes. FIG. 2 illustrates, for clarity, the structured member 106 alone in plan view. As shown in these figures, the structured member 106 is a woven scrim having struts 118, 120 aligned along respective directions that are orthogonal to each other. The structured member 106 therefore presents a two-dimensional array of rectangular holes 116.

Figure 8A:
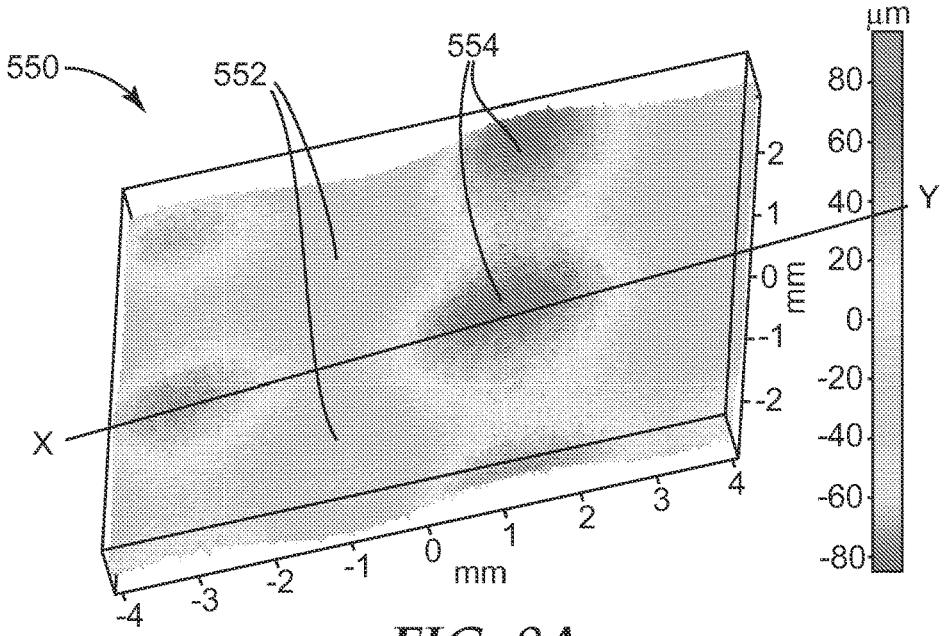
FIGS. 8A and 8B are computerized representations of the topology of an exemplary abrasive article in perspective view and cross-sectional view along line X-Y, respectively.
Figure 8B:
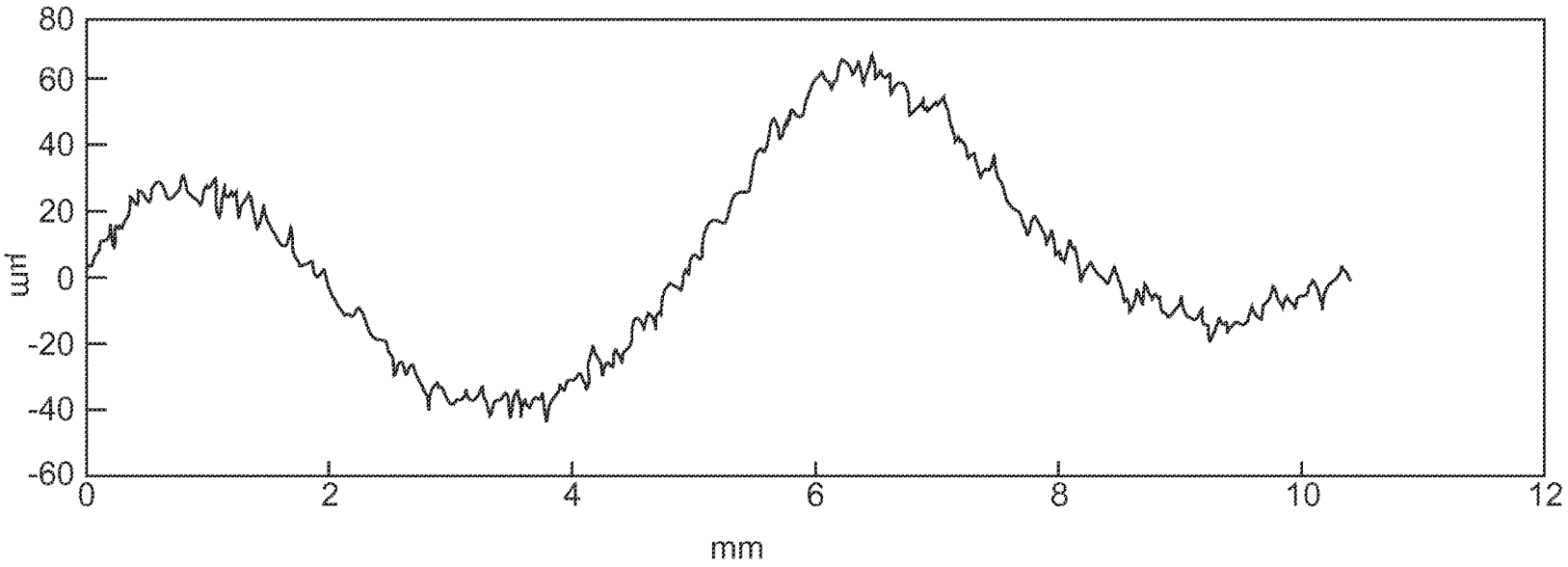

The characteristics of the discrete wells can be examined in a variety of ways, including microscopy. For example, FIG. 8A shows a topological representation of an abrasive article 550 according to one embodiment, with FIG. 8B providing a cross-sectional profile of the same. These figures were obtained using a MikroCAD Lite Fringe Projection 3D Profilometer (GF Messtechnik GmbH, Berlin, Germany). As shown in this representation, the surface of the abrasive article 550 has a two-dimensional array of discrete wells 552 that are isolated from each other by walls 554, where the shapes of both the wells 552 and walls 554 are conformal with the topology of the underlying layers in the abrasive article 550. This example shows that the discrete and isolated nature of the wells 552 need not be precluded by the varying heights of the walls 554. Nonetheless, in such asymmetric configurations, that the overall depth of a given well 552 may be limited by the height of the shortest neighboring wall. This is shown by FIG. 8B, which reveals some variability in both the depth of the wells 552 and height of the walls 554 along the defined cross-section.

The pattern of discrete, isolated wells can derive from a structured member 106 having any of a number of three-dimensional shaped features. These features may come in any shape or combination of shapes and may be provided in either a regular or irregular pattern. Exemplary features include dimples, grooves, posts, bumps, geometric shapes, lattices, graphic designs, and combinations thereof. In certain embodiments, the structured member comprises a mesh screen, punched film, knitted article, woven article, or macrostructured nonwoven article.

Particularly useful nonwoven articles include macrostructured non-woven fabrics. These are typically formed from air or wet-laid fibers. Alternatively, spun-bonded or melt-blown fibers may also be used. Webs formed from these fibers may be subsequently modified to create isolated wells by thermal embossing. Nonwoven articles can be fabricated at a lower cost than knitted or woven fabrics and be formulated to have higher thickness (and therefore deeper wells) without requiring excess polymer due to their low density. The pattern of wells may also be changed by adjusting the surface geometry of the embossing roll, enabling creation of a variety of morphologies.

The features of the structured member 106 also need not be present in a regular array. For instance, the structured member 106 could have a pattern borne from a non-woven web having isolated wells with irregular shapes and sizes.

The structured member 106 preferably has an opening diameter sufficiently large to impart a texture to the abrasive layer 102 sufficient to capture and retain liquid at the first major surface 103. In some embodiments, the structured member 106 has an average opening diameter of at least 0.4 millimeters, at least 0.5 millimeters, at least 0.7 millimeters, at least 0.9 millimeters, or at least 1 millimeter. In some embodiments, the structured member 106 has an average opening diameter of at most 10 millimeters, at most 9 millimeters, at most 8 millimeters, at most 7 millimeters, or at most 6 millimeters.

Referring again to FIG. 1, the abrasive article 100 further includes the second adhesive layer 108, which extends along the major surface of the structured member 106 facing away from the abrasive layer 102. As shown, the second adhesive layer 108 extends between the structured member 106 and the underlying permeable backing 110, and couples these layers to each other. Aspects of the second adhesive layer 108 are essentially analogous to those of the first adhesive layer 104.

Although not shown here, it is possible that one or both of first and second adhesive layers 104, 108 may be omitted where the abrasive layer 102 is directly coupled to the structured member 106, the structured member 106 is directly coupled to the permeable backing 110, or both. Such direct coupling may be achieved, for example, where these adjacent layers are capable of being heat laminated to each other without need for a separate adhesive. For example, the permeable backing 110 and the structured member 106 may be flame laminated to each other.

The next layer, the permeable backing 110, is typically made from a compressible foam. Suitable foams may be formed from any of a number of compressible foam materials known in the art. In some embodiments, the foam is made from an elastic material such that the foam is resiliently compressible. Elastic foams include, for example, chloroprene rubber foams, ethylene/propylene rubber foams, butyl rubber foams, polybutadiene foams, polyisoprene foams, ethylene propylene diene monomer (EPDM) polymer foams, polyurethane foams, ethylene-vinyl acetate foams, neoprene foams, and styrene/butadiene copolymer foams. Other useful foams may include thermoplastic foams such as, for example, polyethylene foams, polypropylene foams, polybutylene foams, polystyrene foams, polyamide foams, polyester foams, and plasticized polyvinyl chloride foams.

The permeable backing 110 may be open-celled or closed-celled, although typically, if the abrasive article 100 is intended for use with liquids, an open-celled foam having sufficient porosity to permit the entry of liquid is desirable. Advantageously, open-celled foams can allow water or some other liquid to be conveyed through the permeable backing 110 along both normal and transverse directions (i.e. perpendicular and parallel the plane of the abrasive article 100, respectively). Particular examples of useful open-celled foams are polyester polyurethane foams, sold under the trade designations "R 200U", "R 400U", "R 600U" and "EF3-700C" by Illbruck, Inc., Minneapolis, Minn.

Particularly suitable open-celled foams may have a number average cell count of at least 15 per cm, at least 16 per cm, at least 17 per cm, at least 18 per cm, at least 19 per cm, or at least 20 per cm. Further, these open-celled foams may have a number average cell count of at most 40 per cm, at most 38 per cm, at most 36 per cm, at most 34 per cm, at most 32 per cm, or at most 30 per cm. These same foams may have an overall density of at least 32 $kg/m^3$, at least 36 $kg/m^3$, at least 41 $kg/m^3$, at least 45 $kg/m^3$, at least 49 $kg/m^3$, or at least 50 $kg/m^3$, and an overall density of at most 128 $kg/m^3$, at most 112 $kg/m^3$, at most 96 $kg/m^3$, at most 76 $kg/m^3$, or at most 60 $kg/m^3$.

If desired, the permeable backing 110 may also be made from a porous nonwoven material.

Optionally and as shown in FIG. 1, the permeable backing 110 includes the attachment interface layer 122. The attachment interface layer 122 may be adhesively, chemically, or mechanically attached to the adjacent permeable backing 110 using the any of the methods previously described.

The attachment interface layer 122 facilitates attachment of the abrasive article 100 to a support structure such as, for example, a backup pad which can in turn be secured to a power tool. The attachment interface layer 122 may be, for example an adhesive (e.g., a pressure-sensitive adhesive) layer, a double-sided adhesive tape, a loop fabric for a hook and loop attachment (e.g., for use with a backup or support pad having a hooked structure affixed thereto), a hooked structure for a hook and loop attachment (e.g., for use with a back up or support pad having a looped fabric affixed thereto), or an intermeshing attachment interface layer (e.g., mushroom type interlocking fasteners designed to mesh with a like mushroom type interlocking fastener on a back up or support pad). Particular options and advantages associated with such attachment interface layers may be found, for example, in U.S. Pat. No. 5,152,917 (Pieper et al); U.S. Pat. No. 5,254,194 (Ott); U.S. Pat. No. 5,201,101 (Rouser et al); and U.S. Pat. No. 6,846,232 (Braunschweig et al.) and U.S. Patent Publication 2003/0022604 (Annen et al).

The abrasive article 100 may be provided in any form, such as a sheet, belt, or disc, and encompass a wide range of overall dimensions.

Figure 3:
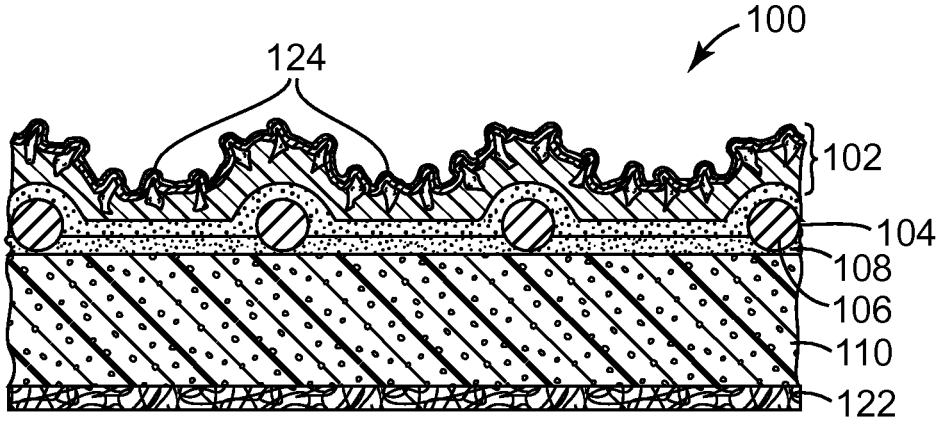
FIG. 3 is a side cross-sectional view of the abrasive article of FIG. 1 as assembled.

FIG. 3 shows the abrasive article 100 shown with all constituent layers collapsed to form a finished abrasive product. As depicted, the layers of the abrasive article 100 in the vicinity of the structured member 106 are shaped in three dimensions by the structured member 106. This is manifest, for example, by the configurations of adjacent adhesive layers 104, 108 and abrasive layer 102, each of which substantially conforms to, and is replicated by, the facing three-dimensional contours of the structured member 106.

In a preferred embodiment, the abrasive layer 102, first adhesive layer 104, and structured member 106 display respective three-dimensional patterns that substantially conform with each other. The correspondence between these two layers can be shown, for example, by the alignment of three-dimensional topological features amongst the abrasive layer 102, the first adhesive layer 104 and the structured member 106.

Alignment of features may be defined along either transverse or normal directions, or both, with respect to the plane of the abrasive article 100. In transverse alignment, corresponding features on the abrasive layer 102, first adhesive layer 104 and the structured member 106 correspond with respect to their lateral diameter, shape (in plan view), arrangement and/or spacing relative to each other. In normal alignment, features on the abrasive layer 102, first adhesive layer 104 and the structured member 106 correspond in cross-sectional view—for example, with respect to their peak-to-valley height and/or cross-sectional shape.

The normal alignment between features of the structured member 106 and its neighboring layers is often imperfect. In particular, the sharpness of the three-dimensional surface features may be somewhat attenuated, depending on the number and thickness of adjacent layers disposed on the structured member 106. As a result, the peak-to-valley height of embossed features visible on the exposed surface of the abrasive article 100 will normally be reduced as additional layers are disposed onto the structured member 106.

The transverse alignment between features of the structured member 106 and its neighboring layers also may not be perfect. For example, boundaries defining the features may shift or become less precise when transferred through the abrasive layer 102. Nonetheless, and as shown in FIGS. 1 and 3, preferred embodiments of the abrasive article 100 include a replicated pattern of discrete, isolated wells 124 having surface contours that are transversely aligned with those of the rectangular holes 116 of the structured member 106.

Figure 4:
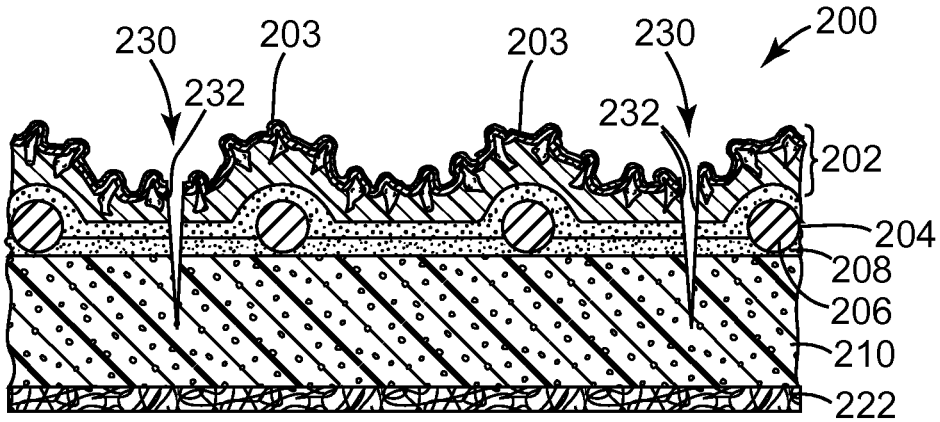
FIG. 4 is a side cross-sectional view of the abrasive article of FIGS. 1 and 3 after further optional conversion steps.

FIG. 4 shows a further improved abrasive article 200 having many of the same features as article 100, including a flexible abrasive layer 202, first and second adhesive layers 204, 208, structured member 206, permeable backing 210, and attachment interface layer 222. Here, each of the layers has a structure and function similar or identical to those previously described with respect to abrasive article 100.

As further shown by FIG. 4, the abrasive article 200 has slits 230 extending across a first major surface 203 of the flexible abrasive layer 202. The slits 230 fully penetrate through the flexible abrasive layer 202 and at least partially through the permeable backing 210. For example, the slits 230 may extend at least 10 percent, at least 20 percent, at least 30 percent, at least 40 percent, at least 50 percent, at least 60 percent, at least 70 percent, at least 80 percent, or at least 90 percent through the permeable backing 210 but not extend through the attachment interface layer 222.

If desired, the slits 230 may penetrate all the way through the permeable backing 210 but do not extend through the attachment interface layer 222. The slits 230 may also extend entirely through the entire abrasive article 200, including the attachment interface layer 222. In an exemplary embodiment, the abrasive article 200 has a plurality of parallel slits 230 that are evenly spaced from each other and extend across most if not all of the major surface 203.

The slits 230 preferably have a maximum width that is essentially zero or near zero when the abrasive article 200 is in a relaxed configuration, although a finite width is shown in FIG. 4 for illustrative purposes. Each slit 230 has a pair of matching and generally contiguous slit surfaces 232. The slit surfaces 232 may touch each other along the entire depth dimension of the slit 230, at various points along the depth dimension, or at only at the base (i.e. the deepest point) of the slit 230.

When the abrasive article 200 is in use, the slits 230 may assume open configurations (having a maximum width substantially greater than zero) resulting from the abrasive article 200 being deflected (or flexed) along directions that pull the slit surfaces 232 apart. Such deflection may occur through a bending motion that produces convexity in the first major surface 203. The slit surfaces 232 may also separate occur in which the abrasive article 200 is compressed to a greater or lesser degree on one side of the slit 230 than the other. When this occurs, the slit surfaces 232 are further exposed in the vicinity of the abrading interface, allowing liquid to flow into, and out of, the permeable backing 210 in a more facile manner.

The opening and closing of the slits 230 in response to differential pressure can be especially beneficial when abrading a substrate having a curved or irregular surface. In these situations, significant gaps may appear between the major surface 203 and the substrate, which can become suffused with liquid. This, in turn, can lead to hydroplaning and poor abrasive performance. When the slits 230 are present, they tend to open up when the abrasive article 200 is urged against such surfaces to facilitate liquid drainage and reduce hydroplaning.

In some embodiments, the overall abrasive article 200 has sufficient resilience that it naturally returns back to its relaxed configuration in which the slits 230 are substantially closed. Typically, this corresponds to the abrasive article 200 being in a flat configuration.

As a further advantage, the depicted slit configuration increases the flexibility of the abrasive article 200, particularly along bends made parallel the slits 230.

Compared with cutting holes, disposing the slits 230 on the abrasive article 200 is also advantageous from a manufacturing perspective because there is no need to remove pips or other debris when converting the abrasive article precursors (such as abrasive article 100) into slitted counterparts. The slits 230 can be produced by mechanically cutting the abrasive article 100 using a blade or by conversion using a laser.

In alternative embodiments, one or more constituent layers of the abrasive article 200 are omitted. For example, the structured member 206 and adhesive layer 208 may be omitted such that the abrasive layer 202 is adhered directly to the permeable backing 210 by the adhesive layer 204. In other alternatives, the attachment interface layer 222 or adhesive layer 204 may also be omitted.

Figure 5:
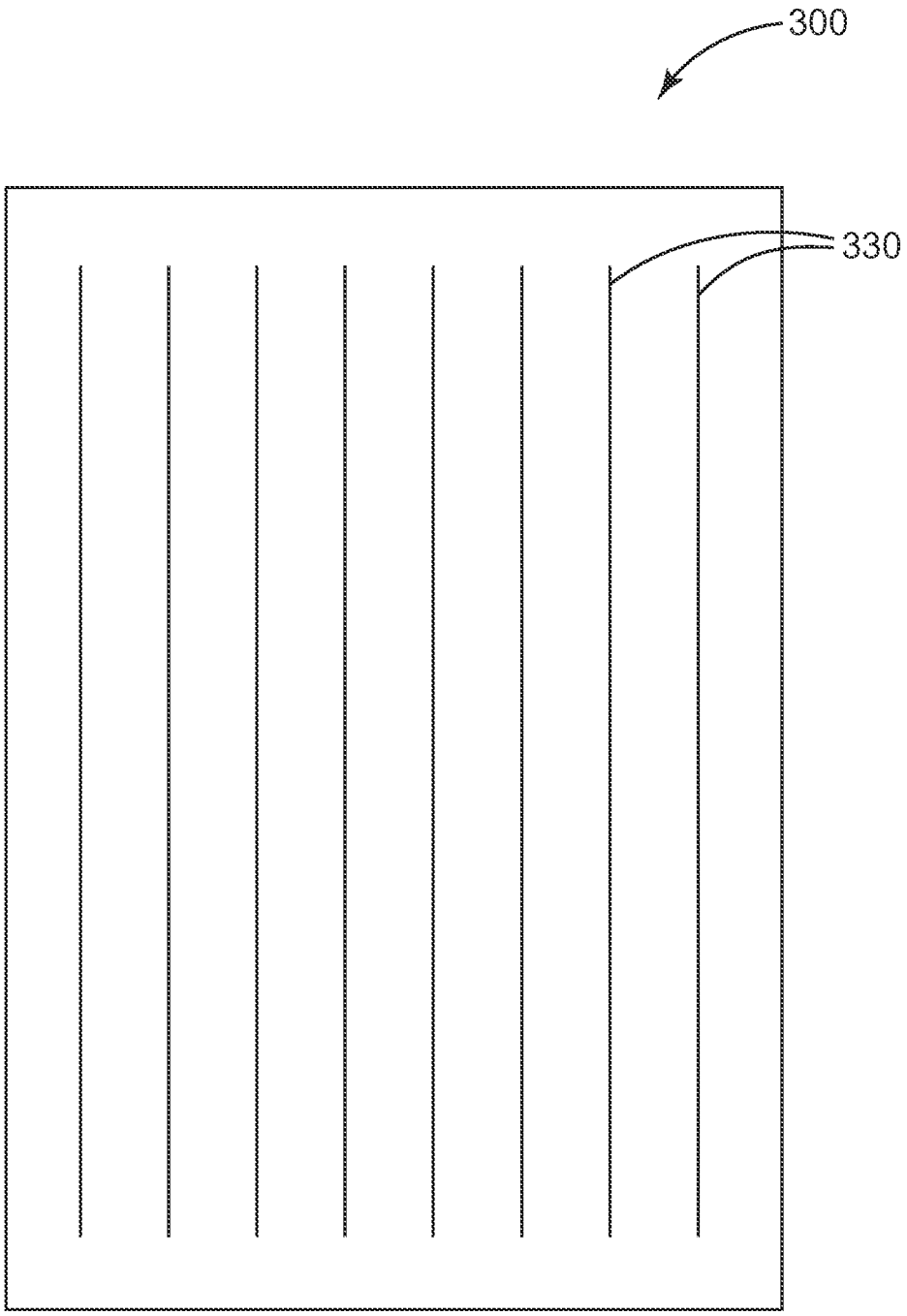
FIGS. 5-7 are plan views of abrasive articles according to three different embodiments.
Figure 6:
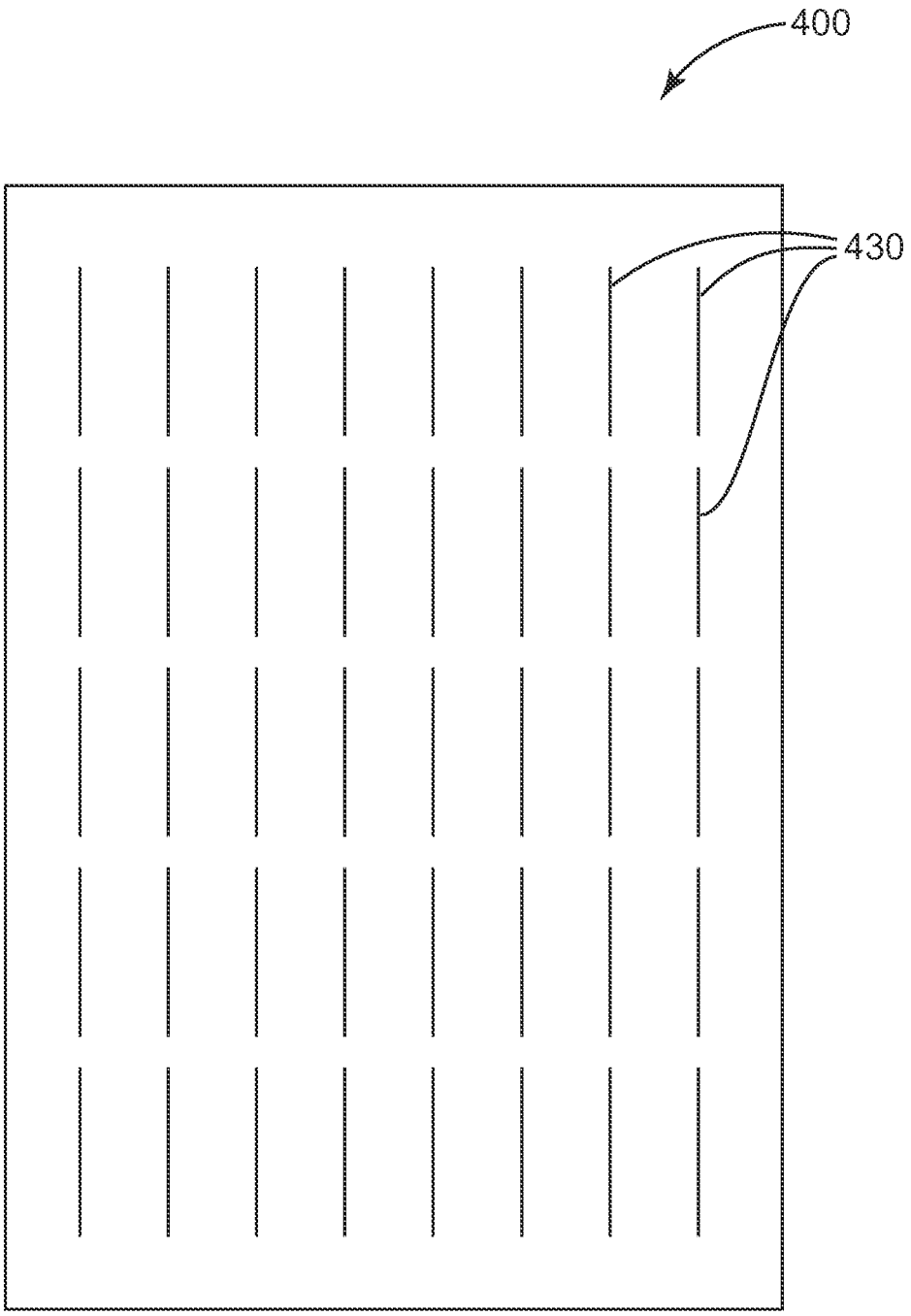
Figure 7:
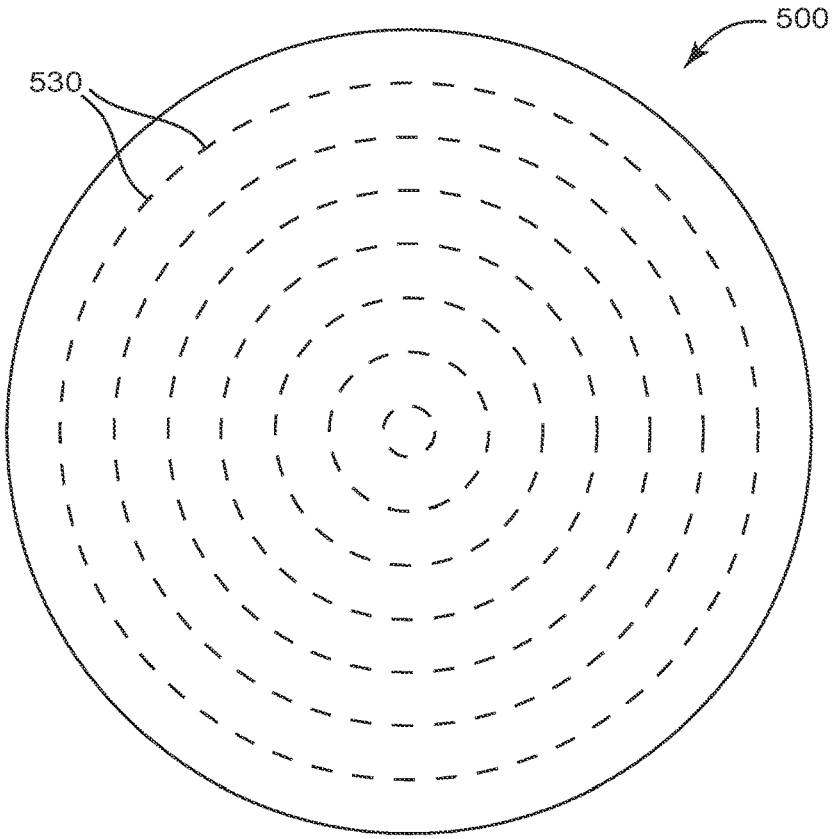

FIGS. 5-7 show various slit configurations in plan view. FIG. 5 shows an abrasive article 300 having array of parallel slits 330, each extending along nearly its entire length. FIG. 6 shows an abrasive article 400 having array of parallel slits 430 similar to that of abrasive article 300 except that the slits 430 are interrupted in a broken line configuration. FIG. 7 shows a circular abrasive article 500 having interrupted curved slits 530 extending along circumferential directions. Optionally but not shown, the slits in FIG. 5 could be disposed in a staggered pattern to facilitate web handling in a continuous manufacturing process.

Additional features are possible. For instance, as described in co-pending U.S. Provisional Patent Application, "TEXTURED ABRASIVE ARTICLE AND RELATED METHODS," Ser. No. 62/060677 (Whittaker), filed on the same day as the present application, the foam backing could be omitted from the abrasive articles and instead incorporated into the backup pad of the power tool to reduce manufacturing costs. In one such embodiment, the structured member is adhesively coupled directly to an attachment interface layer.

Methods of Use

The provided abrasive articles may be used for abrading (including finishing) a substrate by hand or in combination with a power tool such as for example, a rotary sander, orbital sander, or belt sander.

The provided abrasive articles can be used in any of a number of ways known to one skilled in the art, depending on the particular application. Advantageous methods of use include: applying a fluid to either the abrasive article or the substrate, placing the flexible abrasive article in frictional contact with the substrate; and then displacing at least one of the abrasive article and the substrate relative to the other to abrade at least a portion of the surface of the substrate. The abrasive article may translate, rotate, or undergo both in an oscillating pattern, relative to the substrate during use.

When the provided abrasive articles were placed in frictional contact with the substrate, the array of isolated wells was observed to allow a sufficient quantity of liquid (typically water) to be retained on the flexible abrasive layer to alleviate, or eliminate altogether, the problem of stiction. At the same time, slits disposed in the abrasive article were observed to dynamically distribute fluid within the foam layer to prevent hydroplaning during an abrading operation. Redistribution of the liquid through the slits occurs when pressure is applied to the permeable backing during an abrading operation, which urges liquid from excessively wet portions of the interface toward comparatively drier portions.

The substrate referred to above can be any of a variety of materials including painted substrates (e. g., having a clear coat, color coat, or primer), coated substrates (e.g., coated with polyurethane or lacquer), plastics (thermoplastic, thermosetting), reinforced plastics, metal (e.g., carbon steel, brass, copper, mild steel, stainless steel, and titanium) metal alloys, ceramics, glass, wood, wood-like materials, composites, stones, stone-like materials, and combinations thereof. The substrate may be flat or may have a shape or contour associated therewith.

Particular examples of substrates that may be polished by the abrasive article of the invention include metal or wooden furniture, painted or unpainted motor vehicle surfaces (car doors, hoods, trunks, etc.), plastic automotive components (headlamp covers, tail-lamp covers, other lamp covers, arm rests, instrument panels, bumpers, etc.), flooring (vinyl, stone, wood and wood-like materials), counter tops, and other plastic components.

The fluid applied to the abrasive article or substrate generally comprises a liquid that acts as a lubricant and can carry away particles dislodged in the abrading process. In doing so, the liquid can prevent clogging of the grit at the interface between the abrasive and substrate. Suitable liquids may include, for example, water, organic compounds, additives such as defoamers, degreasers, liquids, soaps, corrosion inhibitors, and combinations thereof.

The provided articles and methods can be further exemplified by the embodiments A-AI, set out below:

A. An abrasive article including: a flexible abrasive layer having opposed first and second major surfaces; a permeable backing bonded to the second major surface, the permeable backing being resiliently compressible; and a plurality of slits disposed on the first major surface and penetrating through the flexible abrasive layer and at least partially through the permeable backing.

B. The abrasive article of embodiment A, further including a certain adhesive layer disposed between the flexible abrasive layer and the permeable backing, the certain adhesive layer coupling the flexible abrasive layer and the permeable backing to each other.

C. The abrasive article of embodiment A, further including a structured member disposed between the flexible abrasive layer and the permeable backing, where the structured member and the flexible abrasive layer have respective three-dimensional patterns of discrete, isolated wells that conform with each other.

D. The abrasive article of embodiment C, further including a first adhesive layer disposed between the flexible abrasive layer and the structured member, the first adhesive layer coupling the flexible abrasive layer and the structured member to each other.

E. The abrasive article of embodiment D, further including a second adhesive layer disposed between the structured member and the permeable backing, the second adhesive layer coupling the structured member and the permeable backing to each other.

F. An abrasive article including: a flexible abrasive layer having opposed first and second major surfaces; a structured member extending across the second major surface of the flexible abrasive layer, where the structured member and the flexible abrasive layer have respective three-dimensional patterns of discrete, isolated wells that conform with each other; and a permeable backing extending across a major surface of the structured member opposite the flexible abrasive layer, the permeable backing being resiliently compressible.

G. The abrasive article of embodiment F, further including a first adhesive layer extending across the second major surface of the flexible abrasive layer, the first adhesive layer coupling the flexible abrasive layer and the structured member to each other.

H. The abrasive article of embodiment G, further including a second adhesive layer disposed between the structured member and the permeable backing, the second adhesive layer coupling the structured member and the permeable backing to each other.

I. The abrasive article of any one of embodiments F-H, further including a plurality of slits extending across the first major surface of the flexible abrasive layer and penetrating through the flexible abrasive layer, structured member, and at least partially through the permeable backing.

J. The abrasive article of any one of embodiments C-I, where the structured member is selected from the group consisting of: a mesh screen, punched film, knitted article, and woven article.

K. The abrasive article of embodiment J, where the structured member has an average opening diameter ranging from 0.4 millimeters to 10 millimeters.

L. The abrasive article of embodiment K, where the structured member has an average opening diameter ranging from 0.7 millimeters to 8 millimeters.

M. The abrasive article of embodiment L, where the structured member has an average opening diameter ranging from 1 millimeter to 6 millimeters.

N. The abrasive article of any one of embodiments C-I, where the structured member includes a nonwoven material.

O. The abrasive article of embodiment A, B, or I, where each slit has a pair of matching and generally contiguous surfaces.

P. The abrasive article of any one of embodiments A-O, where the flexible abrasive layer includes a coated abrasive film.

Q. The abrasive article of embodiment P, where the coated abrasive film includes: an elastomeric carrier film; and abrasive particles adhered to the elastomeric carrier film.

R. The abrasive article of embodiment Q, where the elastomeric carrier film is conformable.

S. The abrasive article of embodiment Q or R, where the elastomeric carrier film comprises a polyurethane carrier film.

T. The abrasive article of embodiment S, where the polyurethane carrier film has a thickness ranging from 10 micrometers to 200 micrometers.

U. The abrasive article of embodiment T, where the polyurethane carrier film has a thickness ranging from 15 micrometers to 100 micrometers.

V. The abrasive article of embodiment U, where the polyurethane carrier film has a thickness ranging from 20 micrometers to 50 micrometers.

W. The abrasive article of any one of embodiments A-O, where the flexible abrasive layer includes a structured abrasive including precisely shaped abrasive composites.

X. The abrasive article of any one of embodiments A-W, where the permeable backing includes an open-celled foam.

Y. The abrasive article of embodiment X, where the open-celled foam has a number average cell count ranging from 15 per cm to 40 per cm.

Z. The abrasive article of embodiment Y, where the open-celled foam has a number average cell count ranging from 17 per cm to 35 per cm.

AA. The abrasive article of embodiment Z, where the open-celled foam has a number average cell count ranging from 20 per cm to 30 per cm.

AB. The abrasive article of any one of embodiments X-AA, where the open-celled foam has a density ranging from 32 $kg/m^3$ to 128 $kg/m^3$.

AC. The abrasive article of embodiment AB, where the open-celled foam has a density ranging from 41 $kg/m^3$ to 96 $kg/m^3$.

AD. The abrasive article of embodiment AC, where the open-celled foam has a density ranging from 50 $kg/m^3$ to 60 $kg/m^3$.

AE. The abrasive article of any one of embodiments A-W, where the permeable backing includes a non-woven material.

AF. A method of abrading a substrate using the abrasive article of embodiment C or F, the method including: applying a fluid to either the abrasive article or the substrate; and placing the abrasive article in frictional contact with the substrate, whereby the pattern of wells captures and retains fluid on the flexible abrasive layer while the slits dynamically distribute fluid within the permeable backing.

AG. A method of making an abrasive article including: disposing a structured member onto a permeable backing, where the permeable backing is resiliently compressible and the structured member has a three-dimensional pattern of discrete, isolated wells; and disposing a flexible abrasive layer on the structured member opposite the permeable backing to replicate at least a portion of the three-dimensional pattern onto the first major surface of the flexible abrasive layer.

AH. The method of embodiment AG, further including cutting a plurality of slits into the first major surface of the flexible abrasive layer.

AI. The method of embodiment AH, where the plurality of slits penetrate through the flexible abrasive layer and at least partially through the permeable backing.

EXAMPLES

Unless otherwise noted, all parts, percentages, ratios, etc. in the examples and the rest of the specification are by weight, and all reagents used in the examples were obtained, or are available, from general chemical suppliers such as, for example, Sigma-Aldrich Company, Saint Louis, Mo., or may be synthesized by conventional methods.

The following abbreviations are used to describe the examples:

° C.: degrees Centigrade
lb: pound
mil: $10^{-3}$ inches
ml: milliliters
mm: millimeters
cm: centimeters
kPa: kilopascals
psi: pounds per square inch
kg: kilogram
s: second

Example 1

An abrasive film, commercially available under the trade designation 'P800 Flexible Abrasive Hookit Sheet PN 34340' from 3M Company, St Paul, Minn., had a layer of transfer adhesive, commercially available under the trade designation 'HS300LSE' from 3M Company, St. Paul, Minn., applied to its backing surface. One surface of a mesh/scrim, commercially available under the trade designation 'CLAF HS-0337' from JX Nippon Oil and Energy Corp., Tokyo, Japan was adhered to the abrasive film using the transfer adhesive. On the opposite surface of the mesh, another layer of the transfer adhesive was applied. A 6 mm thick open-cell polyester-polyurethane foam, commercially available under the product code 'XS11264F' from Vita Cellular Foams Ltd., Lancs., UK, was then adhered to the second surface of the mesh using the second layer of transfer adhesive. A polypropylene loop material, part of a hook and loop mechanical fastener system, was laminated to the foam using the flame lamination technique whereby the foam is passed over an open flame, creating a thin layer of molten polymer. The loop material was pressed against the foam while it is still in the molten state with the loops outwardly disposed.

Example 2

Example 2 was carried out according to the method described in Example 1 except slits were mechanically cut into the abrasive film down into the foam layer. The slits were cut approximately 1 mm apart in an arrangement similar to that seen in FIG. 6.

Comparative Example A

An abrasive film, commercially available under the trade designation 'P800 Flexible Abrasive Hookit Sheet PN 34340' from 3M Company, St Paul, Minn., had a layer of transfer adhesive, commercially available under the trade designation 'HS300LSE' from 3M Company, St. Paul, Minn., applied to its backing surface. One surface of an 8 mm thick open-celled polyester-polyurethane foam, commercially available under product code 'XS11264F' from Vita Cellular Foams Ltd., Lancs., UK, was laminated to the abrasive film. A polypropylene loop material, part of a hook and loop mechanical fastener system, commercially available from 3M Company, St. Paul, Minn., was laminated to the foam with a hot-melt polyurethane adhesive, commercially available from Cellular Foams Ltd., Lancs., UK with the loops outwardly disposed, thereby obtaining Comparative Example A.

Comparative Example B

Comparative Example B represented a Grade 1000 coated abrasive disc commercially available from KWH Mirka Ltd., under the trade designation 'Abralon 150 mm 1000'.

6-inch (15.4 cm) diameter discs were die-cut from Example 1, Example 2 and Comparative Example A for the Cut test and the Stiction Test.

Cut Test

Abrasive performance testing was performed on a 19.6 inches by 19.6 inches (50 cm-by 50 cm) black painted cold roll steel test panels having a "SC 2K VOL GOE" clear coat paint applied commercially available from Axalta Coating Systems, Glen Mills, Pa., which had been applied 2 months previous to the test. Each sample disc was attached to a "HOOKIT BACKUP PAD, PART No. 05551," available from 3M Company, St. Paul, Minn. The pad assembly was then secured to a model "28500" random orbital sander available from 3M Company, St. Paul, Minn. 6 squirts of water, each squirt with a volume of approximately 1.1 ml were applied to the panel and 2 squirts of water to the sample disc. Using a line pressure of 40 psi (275.8 kPa) and a down force of approximately 5.5 lbs (roughly 2.5 kg), the panel was scuffed for a total of 105 seconds. The cut in grams was computed by weighing the panel before sanding, then at 15 s after sanding, at 45 s and at 105 s after sanding. The weight after 15 s, 45 s and 105 s was subtracted from the initial panel weight to give cumulative cut results for each sample tested. This procedure was performed on 4 different test samples for each of Example 1 and 2 and Comparative Example A and B. The mean cumulative cut at 15 s for Example 1 was determined by dividing the sum of cut, in grams, for each test sample by 4, which is the total number of test samples. This calculation was repeated for 45 s and 105 s. The results of the Cut test can be found in Table 1.

Stiction Test

Abrasive performance testing was performed on a 50 cm by 50 cm (19.6 inches by 19. inches) black painted cold roll steel test panels having a "SC 2K VOL GOE" clear coat paint applied commercially available from DuPont Performance Coatings GmbH, DE, which had been applied 2 months previous to the test. A sample sanding disc, was attached to a "HOOKIT BACKUP PAD, PART No. 05551" commercially available from 3M Company, St. Paul, Minn. The disc was attached to a dual action pneumatic sander commercially available under the trade designation 'RA 150A' from Rupes S.p.A., Italy. 6 squirts of water, each squirt with a volume of approximately 1.1 ml were applied to the panel and 2 squirts of water to the sample disc. The panel was abraded for approximately 2 minutes and 'Stiction', that is, the tendency for the abrasive coating to stick to the workpiece surface, with unwanted results, was noted. This procedure was performed on 4 different test samples for each of Example 1 and 2 and Comparative Example A and B. The results of the Stiction test can be found in Table 1.

TABLE 1

| Sample | Sanding Time (seconds) | Mean Cumulative Cut (grams) | Stiction |
|---|---|---|---|
| Example 1 | 15 | 0.080 | Low. Very mild |
| | 45 | 0.520 | vibration throughout. |
| | 105 | 0.930 | Disc kept rotating. |
| Example 2 | 15 | 0.095 | Very low. Very mild |
| | 45 | 0.500 | vibration throughout. |
| | 105 | 0.910 | Good absorption of water. Disc kept rotating. |
| Comparative Example A | 15 | 0.009 | High. Mild vibration, |
| | 45 | 0.535 | increases over time. |
| | 105 | 0.900 | Disc stopped rotating. |
| Comparative Example B | 15 | 0.055 | Very low. |
| | 45 | 0.175 | |
| | 105 | 0.295 | |

All patents and patent applications mentioned above are hereby expressly incorporated by reference. Although the invention herein has been described with reference to particular embodiments, it is to be understood that these embodiments are merely illustrative of the principles and applications of the present invention. It will be apparent to those skilled in the art that various modifications and variations can be made to the method and apparatus of the present invention without departing from the spirit and scope of the invention. Thus, it is intended that the present invention include modifications and variations that are within the scope of the appended claims and their equivalents.

What is claimed is:

1. An abrasive article comprising:

a flexible abrasive layer having opposed first and second major surfaces;

a structured member extending across the second major surface of the flexible abrasive layer, wherein the structured member and the flexible abrasive layer have respective three-dimensional patterns of discrete, isolated wells that conform with each other; and a permeable backing extending across a major surface of the structured member opposite the flexible abrasive layer, the permeable backing being resiliently compressible.

2. The abrasive article of claim 1, further comprising a first adhesive layer extending across the second major surface of the flexible abrasive layer, the first adhesive layer coupling the flexible abrasive layer and the structured member to each other.

3. The abrasive article of claim 2, further comprising a second adhesive layer disposed between the structured member and the permeable backing, the second adhesive layer coupling the structured member and the permeable backing to each other.

4. The abrasive article of claim 1, further comprising a plurality of slits extending across the first major surface of the flexible abrasive layer and penetrating through the flexible abrasive layer, structured member, and at least partially through the permeable backing.

5. The abrasive article of claim 1, wherein the structured member is selected from the group consisting of: a mesh screen, punched film, knitted article, woven article, and macrostructured nonwoven article.

6. The abrasive article of claim 5, wherein the structured member has an average opening diameter ranging from 0.4 millimeters to 10 millimeters.

7. The abrasive article of claim 6, wherein the structured member has an average opening diameter ranging from 0.7 millimeters to 8 millimeters.

8. The abrasive article of claim 7, wherein the structured member has an average opening diameter ranging from 1 millimeter to 6 millimeters.

9. A method of abrading a substrate using the abrasive article of any one of claim 4, the method comprising:

applying a fluid to either the abrasive article or the substrate; and placing the abrasive article in frictional contact with the substrate, whereby the pattern of discrete, isolated wells captures and retains fluid on the flexible abrasive layer as the slits dynamically distribute fluid within the permeable backing.

10. A method of making an abrasive article comprising:

disposing a structured member onto a permeable backing, wherein the permeable backing is resiliently compressible and the structured member has a three-dimensional pattern of discrete, isolated wells; and disposing a flexible abrasive layer on the structured member opposite the permeable backing to replicate at least a portion of the three-dimensional pattern onto the first major surface of the flexible abrasive layer.

* * * * *